US009852558B2

(12) United States Patent
Cho

(10) Patent No.: US 9,852,558 B2
(45) Date of Patent: Dec. 26, 2017

(54) SECURITY APPARATUS FOR ENERGY STORAGE SYSTEM

(71) Applicant: LSIS CO., LTD., Anyang-si, Gyeonggi-do (KR)

(72) Inventor: Duk Yun Cho, Suwon-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/630,457

(22) Filed: Feb. 24, 2015

(65) Prior Publication Data

US 2015/0262437 A1 Sep. 17, 2015

(30) Foreign Application Priority Data

Mar. 17, 2014 (KR) ..... 10-2014-0031203

(51) Int. Cl.
*G07C 9/00* (2006.01)

(52) U.S. Cl.
CPC ..... *G07C 9/00126* (2013.01); *G07C 2209/04* (2013.01); *G07C 2209/62* (2013.01)

(58) Field of Classification Search
CPC ..... G07C 9/00126; G07C 9/00023; G07C 9/00912; G07C 2209/62; G07C 2209/04; G07C 2209/08; G07C 2009/0092; G07F 19/20; G07F 19/206; G07F 19/207; G07F 19/209; G08B 29/02; G08B 29/04; G08B 29/046
See application file for complete search history.

(56) References Cited

U.S. PATENT DOCUMENTS

2007/0108267 A1* 5/2007 Jonsson ..... G07D 3/14 235/379
2008/0243391 A1* 10/2008 Ohshiro ..... G05B 15/02 702/2
2012/0138677 A1 6/2012 Ma et al.
2012/0223134 A1 9/2012 Smith et al.
(Continued)

FOREIGN PATENT DOCUMENTS

JP 2001123719 5/2001
JP 2003135565 5/2003
(Continued)

OTHER PUBLICATIONS

Japan Patent Office Application Serial No. 2015-053254, Office Action dated Apr. 5, 2016, 1 pages.
(Continued)

*Primary Examiner* — Laura Nguyen
(74) *Attorney, Agent, or Firm* — Lee Hong Degerman Kang & Waimey

(57) ABSTRACT

A security apparatus for an energy storage system is provided. The security apparatus includes a sensor input unit receiving security state information including door opening and closing and locking/unlocking from a door opening and closing sensor and a locking/unlocking sensor; a human machine interface (HMI) unit receiving information from a user or showing the information to the user; and a security state machine allowing manipulation of the energy storage system depending on whether security state information obtained through the sensor input unit satisfies a security state condition having a plurality of procedures in order.

5 Claims, 6 Drawing Sheets

(56) References Cited

U.S. PATENT DOCUMENTS

| | | | | |
|---|---|---|---|---|
| 2013/0245852 | A1* | 9/2013 | Sanders | G05B 15/02 700/295 |
| 2014/0129440 | A1* | 5/2014 | Smith | G06Q 20/042 705/43 |
| 2015/0076222 | A1* | 3/2015 | Ma | G07F 19/207 235/379 |

FOREIGN PATENT DOCUMENTS

| | | |
|---|---|---|
| JP | 2008038353 | 2/2008 |
| JP | 2008-059407 | 3/2008 |
| JP | 4530087 | 8/2010 |
| KR | 10-2011-0088133 | 8/2011 |
| KR | 10-2012-0058953 | 6/2012 |

OTHER PUBLICATIONS

State Intellectual Property Office of the People's Republic of China Application Serial No. 201510116943.5, Office Action dated Jul. 11, 2017, 9 pages.

* cited by examiner

FIG.4

USER MODE - MANAGER MODE SWITCH CONDITION

SWITCH TO MANAGER MODE THROUGH HMI,
UNLOCK AND DOOR OPEN IN ORDER

USER MODE - ERROR MODE SWITCH CONDITION

ANY ONE OF FOLLOWING CONDITIONS IS SATISFIED
1. SWITCH TO MANAGER MODE THROUGH HMI
AND OPEN DOOR IN LOCKED STATE
2. UNLOCK WITHOUT SWITCH TO MANAGER MODE THROUGH HMI
3. OPEN DOOR WITHOUT SWITCH TO MANAGER MODE THROUGH HMI

MANAGER MODE - USER MODE SWITCH CONDITION 1

CLOSE DOOR, LOCK AND THEN SWITCH
TO USER MODE THROUGH HMI

MANAGER MODE - USER MODE SWITCH CONDITION 2

CLOSE DOOR AND LOCK (AUTOMATIC SWITCH TO
USER MODE AFTER PREDEFINED TIME ELAPSES)

MANAGER MODE - ERROR MODE SWITCH CONDITION

ATTEMPT TO RESTORE TO USER MODE IN
UNLOCKED STATE OR DOOR OPEN STATE

ERROR MODE - USER MODE SWITCH CONDITION

CLOSE DOOR, LOCK AND THEN SWITCH
TO USER MODE THROUGH HMI

SECURITY APPARATUS FOR ENERGY STORAGE SYSTEM

CROSS-REFERENCE TO RELATED APPLICATIONS

Pursuant to 35 U.S.C. §119(a), this application claims the benefit of earlier filing date and right of priority to Korean Patent Application No 10-2014-0031203, filed on Mar. 17, 2014, the contents of which are hereby incorporated by reference herein in its entirety.

BACKGROUND

The present disclosure relates to a security apparatus for an energy storage system, and more particularly, to a security apparatus for an energy storage system that includes a security state machine and sensor to allow only an authorized manager to manipulate the energy storage system so that it is possible to ensure the safety and security of a device and user.

An energy storage system stores power generated by a grid in a battery or supplies power stored in the battery to the grid or a load.

The energy storage system may be connected to a grid and load to store power supplied from the grid or supply power to the grid or load.

A typical energy storage system has been insufficient for ensuring safety by maintaining security through simply a lock against arbitrary or malicious manipulation by a general user or unauthorized user. Thus, it is apprehended that it is possible to easily cause a problem such as a change in system configuration, conduction, electric shock or fire when the lock is damaged or illegally unlocked.

SUMMARY

Embodiments provide a security apparatus for an energy storage system that includes a security state machine and sensor to allow only an authorized manager to manipulate the energy storage system so that it is possible to ensure the safety and security of a device and user.

In one embodiment, a security apparatus for an energy storage system includes: a sensor input unit receiving security state information including door opening and closing and locking/unlocking from a door opening and closing sensor and a locking/unlocking sensor; a human machine interface (HMI) unit receiving information from a user or showing the information to the user; and a security state machine allowing manipulation of the energy storage system depending on whether security state information obtained through the sensor input unit satisfies a security state condition having a plurality of procedures in order.

The security apparatus may further include a higher communication unit communicating with an external different device.

The security state machine may operate in a plurality of security state modes including a user mode performing general fundamental operations of the energy storage system, a manager mode for opening a door for a regular inspection or management of the energy storage system, and an error mode in which an alarm measure is performed when arbitrary/malicious manipulation is recognized, switch conditions between the plurality of security state modes may include a user mode-manager mode switch condition, a user mode-error mode switch condition, a manager mode-user mode switch condition, a manager mode-error mode switch condition, and an error mode-user mode switch condition.

The user mode-manager mode switch condition may correspond to switching from a user mode state to a manager mode through the HMI unit, unlocking a door handle and opening a door in order, and the security state machine may switch from the user mode to the manager mode when the user mode-manager mode switch condition is satisfied.

The user mode-error mode switch condition may be configured to correspond to any one of: switching to the manager mode through the HMI unit and opening a door in a locked state; unlocking without a switch to the manager mode through the HMI unit; or opening the door without a switch to the manager mode through the HMI unit, and the security state machine may switch from the user mode to the error mode when the user mode-error mode switch condition is satisfied.

The manager mode-user mode switch condition may correspond to closing a door, locking a door handle and then switching to the user mode through the HMI unit, and the security state machine may switch from the manager mode to the user mode when the manager mode-user mode switch condition is satisfied.

The manager mode-user mode switch condition may correspond to closing a door and locking a door handle in order, and the security state machine may switch from the manager mode to the user mode after a predefined time elapses, when the manager mode-user mode switch condition is satisfied.

The manager mode-error mode switch condition may correspond to restoring to the user mode through the HMI unit in an unlocked state or door open state, and the security state machine may switch from the manager mode to the error mode when the manager mode-error mode switch condition is satisfied.

The error mode-user mode switch condition may correspond to closing a door, locking a door handle and then switching to the user mode through the HMI unit in order, and the security state machine may switch from the error mode to the user mode when the error mode-user mode switch condition is satisfied.

The door opening and closing sensor may include a camera sensor, and the camera sensor may perform an image capturing operation when a door opens.

In another embodiment, a method of operating a security apparatus for an energy storage system includes obtaining security state information including door opening and closing and locking/unlocking from a door opening and closing sensor and a locking/unlocking sensor; and allowing manipulation of the energy storage system depending on whether obtained security state information satisfies a security state condition having a plurality of procedures in order.

The details of one or more embodiments are set forth in the accompanying drawings and the description below. Other features will be apparent from the description and drawings, and from the claims.

BRIEF DESCRIPTION OF THE DRAWINGS

FIG. 4 is a diagram for explaining a condition for a switch between security state modes in a security apparatus for an energy storage system according to an embodiment.

DETAILED DESCRIPTION OF THE EMBODIMENTS

Figure 1:
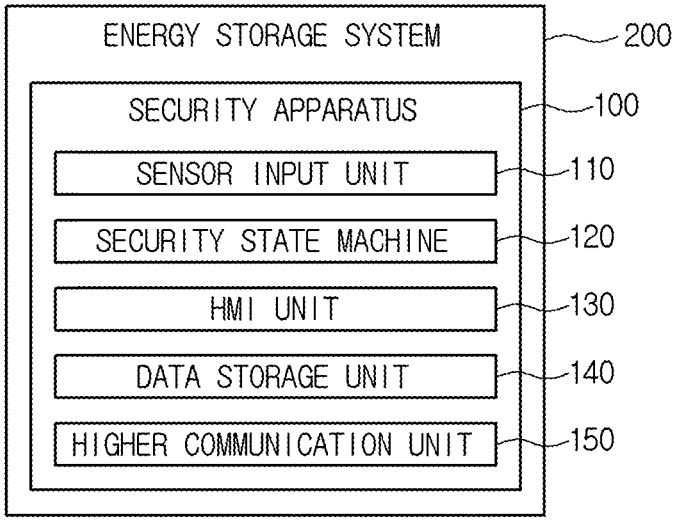
FIG. 1 shows a security apparatus for an energy storage system according to an embodiment.

Various embodiments are described below in detail with reference to the accompanying drawings. The following embodiments are provided as examples so that the spirit of the present invention may be fully delivered to a person skilled in the art. Thus, the present invention is not limited embodiments to be described below but may be implemented in other forms. In addition, the width, length, and thickness of components in the drawings may be exaggerated for convenience. The same reference numerals represent the same components throughout the disclosure.

Figure 2:
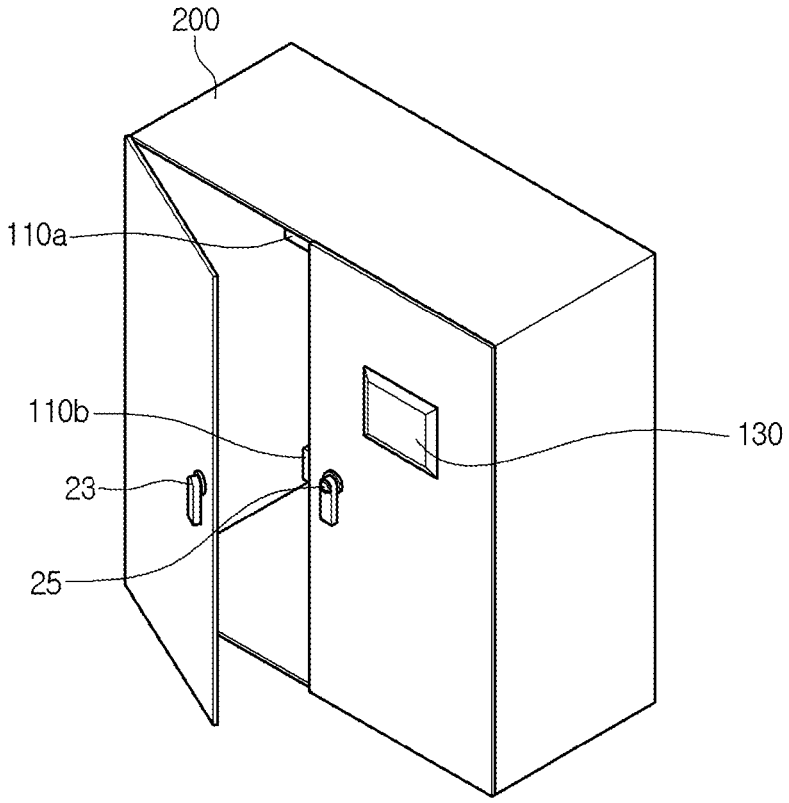
FIG. 2 shows an energy storage system in which a security apparatus for an energy storage system according to an embodiment is installed.

FIG. 1 shows a security apparatus for an energy storage system according to an embodiment, and FIG. 2 shows an energy storage system in which a security apparatus for an energy storage system according to an embodiment is installed.

Referring to FIG. 1, a security apparatus 100 for an energy storage system 200 according to an embodiment is installed in the energy storage system 200 and may include a sensor input unit 110, a security state machine 120, a human machine interface (HMI) unit 130, a data storage unit 140, and a higher communication unit 150.

The sensor input unit 110 receives security state information from a door opening and closing sensor and a locking/unlocking sensor.

The security state machine 120 operates in a plurality of security state modes and allows the manipulation of the energy storage system 200 depending on whether the security state information obtained through the sensor input unit 110 satisfies a security state condition having a plurality of procedures.

The HMI unit 130 receives information from a user or shows information to the user.

The data storage unit 140 stores sensor state, HMI state, and security state information.

The higher communication unit 150 may perform communication with an external device to transmit trespassing information on a trespasser from the security state machine 120 to a manager.

Referring to FIG. 2, the energy storage system 200 in which the security apparatus for the energy storage system according to an embodiment is installed includes a first door opening and closing sensor 110*a* and a second door opening and closing sensor 110*b* and the HMI unit 130.

A door handle 23 is installed on a door on one side and another door handle 25 including a lock is installed on a door on the other side.

The first door opening and closing sensor 110*a* is located on the upper part of the energy storage system 200 and the second door opening and closing sensor 110*b* may be located on the intermediate part of the energy storage system 200 to sense the opening and closing of a door.

The first door opening and closing sensor 110*a* and the second door opening and closing sensor 110*b* may be a contact sensor or a contactless sensor. The first door opening and closing sensor 110*a* and the second door opening and closing sensor 110*b* may be an optical sensor, such as a camera. The first door opening and closing sensor 110*a* and the second door opening and closing sensor 110*b* may be installed by the adopting of the same sensor technique or different sensor techniques.

When the first door opening and closing sensor 110*a* and the second door opening and closing sensor 110*b* are installed along with a camera, the first door opening and closing sensor 110*a* and the second door opening and closing sensor 110*b* may start capturing an image when a door opens. A captured image may be stored in the data storage unit 140 and transmitted to a security manager on the remote site.

Figure 3:
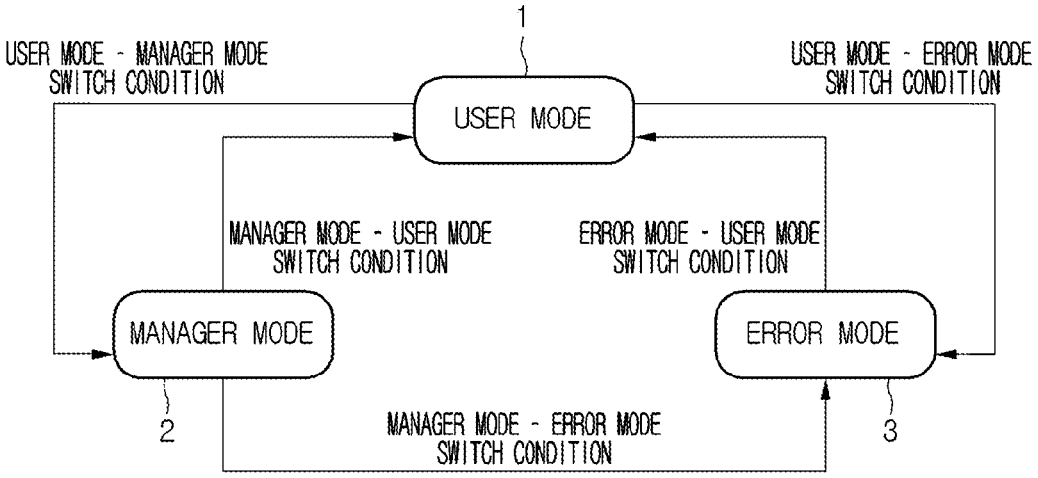
FIG. 3 is a diagram for explaining a plurality of security state modes in a security apparatus for an energy storage system according to an embodiment.

FIG. 3 is a diagram for explaining a plurality of security state modes in a security apparatus for an energy storage system according to an embodiment.

Referring to FIG. 3, a security state machine may manage the operations of the security apparatus according to a user mode 1, a manager mode 2 or an error mode.

The user mode 1 is a mode in which it is possible to perform general fundamental operations (charging and discharging) of the energy storage system. In the user mode, a user may perform manipulation for fundamental operations by using an HMI.

The manager mode 2 is a mode allowing a manager to open a door for a regular inspection or the management of the energy storage system. In order to switch from the user mode to the manger mode, a user mode-manager mode switch condition should be satisfied in order.

The error mode 3 is a mode in which an alarm measure is performed when arbitrary/malicious manipulation is recognized, and in which the HMI unit is inactivated or an alarm is made.

The security state machine 120 is switched to the manager mode when security state information obtained through the sensor input unit 110 in the user mode state satisfies the user mode-manager mode switch condition.

The security state machine 120 is switched to the error mode when security state information obtained through the sensor input unit 110 in the user mode state satisfies a user mode-error mode switch condition.

The security state machine 120 is switched to the user mode when security state information obtained through the sensor input unit 110 in the manager mode state satisfies the manager mode-user mode switch condition.

The security state machine 120 is switched to the error mode when security state information obtained through the sensor input unit 110 in the manager mode state satisfies a manager mode-error mode switch condition.

The security state machine 120 is switched to the user mode when security state information obtained through the sensor input unit 110 in the error mode state satisfies an error mode-user mode switch condition.

FIG. 4 is a diagram for explaining a condition for a switch between security state modes in a security apparatus for an energy storage system according to an embodiment.

Referring to FIG. 4, the security state machine 120 includes the user mode-manager mode switch condition, the user mode-error mode switch condition, the manager mode-user mode switch condition, the manager mode-error mode switch condition, and the error mode-user mode switch condition as conditions for switches between security state modes.

[User Mode-Manager Mode Switch Condition]

The user mode-manager mode switch condition is a condition for switching from the user mode 1 state to the manager mode 2.

The security state machine 120 determines that the user mode-manager mode switch condition is satisfied when the security state information obtained through the sensor input unit 110 corresponds to switching to the manger mode through the HMI, unlocking a door handle, and opening a door.

Under the following condition and not the above condition, the security state machine 120 switches to the error mode 3 in which a notification of abnormal manipulation is provided.

[User Mode-Error Mode Switch Condition]

The user mode-error mode switch condition is a condition for switching from the user mode state to the error mode. Even if any one of the following error switch conditions is satisfied, it is possible to switch to the error mode.

The security state machine 120 determines that the user mode-error mode switch condition is satisfied, when the security state information obtained through the sensor input unit 110 corresponds to the following error switch condition.

First error switch condition: A switch to the manager mode is made through the HMI and a door opens in a locked state.

Second error switch condition: A door is unlocked without a switch to the manager mode through the HMI.

Third error switch condition: A door opens without a switch to the manager mode through the HMI.

Conditions for switching to the user mode after work completion by a manager are as follows.

[Manager Mode-User Mode Switch Condition]

The manager mode-user mode switch condition is a condition for switching from the manager mode state to the user mode.

The security state machine 120 determines that the manager mode-user mode switch condition is satisfied, when the security state information obtained through the sensor input unit 110 corresponds to closing a door, locking a door handle and then switching to the user mode through the HMI.

In this case, setting may be implemented to automatically switch to the user mode when a certain time elapses after the door is closed and the door handle is locked.

Under the following error mode switch condition and not the above condition, the security state machine 120 switches to the error mode in which a notification of abnormal manipulation is provided.

[Manager Mode-Error Mode Switch Condition]

The manager mode-error mode switch condition is a condition for switching from the manager mode state to the error mode.

The security state machine 120 determines that the manager mode-error mode switch condition is satisfied, when the security state information obtained through the sensor input unit 110 corresponds to attempting to return to the user mode through the HMI in an unlocked state or a door open state.

A method of restoring the energy storage system from the error mode representing an abnormal manipulation state to a normal state by a manager is as follows.

[Error Mode-User Mode Switch Condition]

The error mode-user mode switch condition is a condition for switching from the error mode state to the user mode.

The security state machine 120 determines that the error mode-user mode switch condition is satisfied, when the security state information obtained through the sensor input unit 110 corresponds to closing a door, locking a door handle and then switching to the user mode through the HMI.

Figure 5:
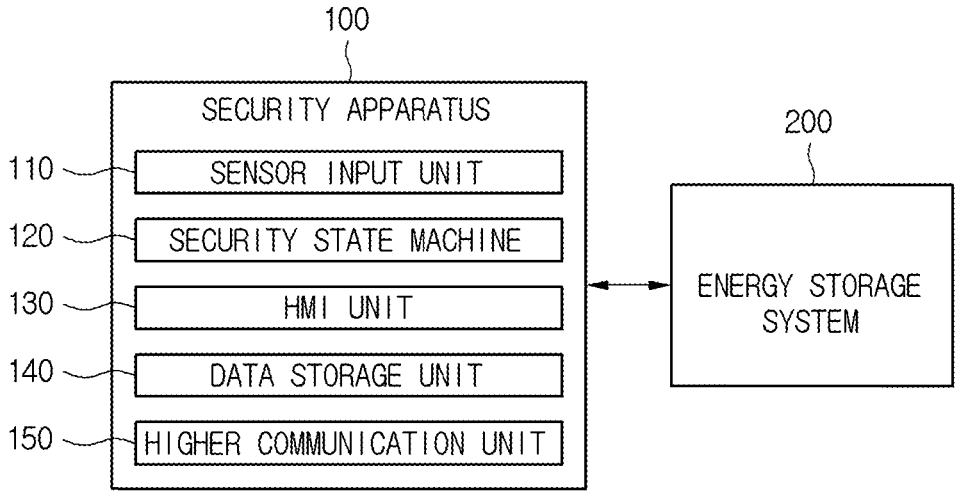
FIG. 5 shows a security apparatus for an energy storage system according to another embodiment.

FIG. 5 shows a security apparatus for an energy storage system according to another embodiment.

Referring to FIG. 5, the security apparatus 100 for an energy storage system according to another embodiment is not installed internal to the energy storage system 200 but is installed external to the energy storage system 200.

Figure 6:
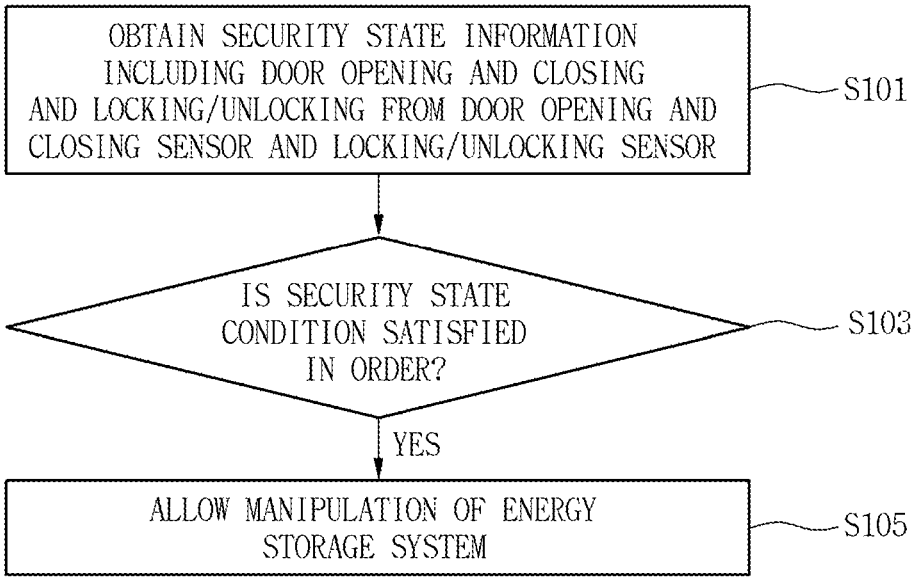
FIG. 6 is a flow chart of a method of operating a security apparatus for an energy storage system according to another embodiment.

FIG. 6 is a flow chart of a method of operating a security apparatus for an energy storage system according to another embodiment.

The sensor input unit 110 obtains security state information including door opening and closing and locking/unlocking from a door opening and closing sensor and a locking/unlocking sensor in step S101.

The security state machine 120 allows the manipulation of the energy storage system depending on whether obtained security state information satisfies a security state condition including a plurality of procedures in order in steps S103 and S105.

In detail, the step of allowing the manipulation of the energy storage system may include the step of switching between a plurality of security state modes including a user mode in which it is possible to perform general fundamental operations of the energy storage system, a manager mode for opening a door for the regular inspection or management of the energy storage system, and an error mode in which an alarm measure is performed when arbitrary/malicious manipulation is recognized.

As described earlier, switch conditions between a plurality of security state modes may include the user mode-manager mode switch condition, the user mode-error mode switch condition, the manager mode-user mode switch condition, the manager mode-error mode switch condition, and the error mode-user mode switch condition.

Also, the user mode-manager mode switch condition may correspond to switching from a user mode state to the manager mode through a user input, unlocking a door handle and opening a door in order. In this case, the security state machine 120 may switch from the user mode to the manager mode when the user mode-manager mode switch condition is satisfied.

Also, the user mode-error mode switch condition may correspond to any one of: switching to the manager mode through a user input and opening a door in a locked state; unlocking without a switch to the manager mode through the user input; or opening the door without a switch to the manager mode through the user input. In this case, the security state machine 120 may switch from the user mode to the error mode when the user mode-error mode switch condition is satisfied.

Also, the manager mode-user mode switch condition may correspond to closing a door, locking a door handle and then switching to the user mode through the HMI unit. In this case, the security state machine 120 may switch from the manager mode to the user mode when the manager mode-user mode switch condition is satisfied. Also, the manager mode-user mode switch condition may correspond to closing a door and locking a door handle in order, and when the manager mode-user mode switch condition is satisfied, the security state machine 120 may switch from the manager mode to the user mode after a predefined time elapses.

According to the present invention, since vulnerability to arbitrary/malicious manipulation by an unauthorized user due to simple security through locking the energy storage system is complemented through a sensor input and the security state machine, it is easy to store and manage state data and thus it is possible to ensure safety through active security.

While particular embodiments have been described in the detailed description of the present invention, many variations may be implemented without departing from the scope of the present invention. Therefore, the scope of the present invention should not be limited to the above-described embodiments but be defined by the following claims and equivalents thereof.

What is claimed is:

1. An energy storage system comprising:

a battery configured to store power generated by a grid and supply power stored in the battery to the grid or a load;

a door lock sensor configured to detect a door handle being locked or unlocked;

a door status sensor configured to detect a door being opened or closed;

a sensor input unit configured to receive security state information comprising information regarding door opening and closing of the energy storage system via the door status sensor and information regarding door locking and unlocking of the energy storage system via the door lock sensor;

a human machine interface (HMI) unit configured to receive input information from a user and display output information; and a security state machine configured to automatically switch an operation mode of the energy storage system depending on whether security state information obtained through the sensor input unit and input by the user through the HMI unit satisfies a security state condition having a plurality of ordered procedures, wherein the security state machine is configured to operate in a plurality of security state modes comprising:

a user mode for performing a charging operation and a discharging operation of the energy storage system, a manager mode for opening the door for a regular inspection or management of the energy storage system, and an error mode in which an alarm measure is performed when arbitrary or malicious manipulation is recognized, wherein the security state machine is configured to change to a security state mode of the plurality of security state modes based on whether a switch condition is satisfied from a plurality of switch conditions comprising:

a user mode-manager mode switch condition, a user mode-error mode switch condition, a manager mode-user mode switch condition, a manager mode-error mode switch condition, and an error mode-user mode switch condition, wherein the security state machine is further configured to switch from the user mode to the error mode when the user mode-error mode switch condition is satisfied, wherein the user mode-error mode switch condition is satisfied when a first input for switching to the manager mode is received via the HMI unit and the door is opened while in a locked state, wherein the manager mode-error mode switch condition corresponds to attempting to return to the user mode via the HMI unit while in an unlocked state or door open state, and the security state machine is further configured to switch from the manager mode to the error mode when the manager mode-error mode switch condition is satisfied, wherein the manager mode-user mode switch condition corresponds to the door being closed, the door handle being locked after the door is closed, and receiving a third input via the HMI unit to switch to the user mode after the door handle is locked, and the security state machine is further configured to switch from the manager mode to the user mode when the manager mode-user mode switch condition is satisfied.

2. The energy storage system according to claim 1, wherein the user mode-manager mode switch condition corresponds to switching from a user mode to the manager mode when the first input is received via the HMI unit, the door handle is unlocked after the first input, and the door is opened after the door handle is unlocked, and the security state machine is further configured to switch from the user mode to the manager mode when the user mode-manager mode switch condition is satisfied.

3. The energy storage system according to claim 1, wherein the manager mode-user mode switch condition corresponds to the door being closed and the door handle being locked after the door is closed, and the security state machine is further configured to switch from the manager mode to the user mode after a predefined time elapses when the manager mode-user mode switch condition is satisfied.

4. The energy storage system according to claim 1, wherein the door status sensor comprises a camera sensor, and the camera sensor performs an image capturing operation when a door opens.

5. An energy storage system comprising:

a battery configured to store power generated by a grid and supply power stored in the battery to the grid or a load;

a door lock sensor configured to detect a door handle being locked or unlocked;

a door status sensor configured to detect a door being opened or closed;

a sensor input unit configured to receive security state information comprising information regarding door opening and closing of the energy storage system via the door status sensor and information regarding door locking and unlocking of the energy storage system via the door lock sensor;

a human machine interface (HMI) unit configured to receive input information from a user and display output information; and a security state machine configured to automatically switch an operation mode of the energy storage system depending on whether security state information obtained through the sensor input unit and input by the user through the HMI unit satisfies a security state condition having a plurality of ordered procedures, wherein the security state machine is configured to operate in a plurality of security state modes comprising:

a user mode for performing a charging operation and a discharging operation of the energy storage system, a manager mode for opening the door for a regular inspection or management of the energy storage system, and an error mode in which an alarm measure is performed when arbitrary or malicious manipulation is recognized, wherein the security state machine is configured to change to a security state mode of the plurality of security state modes based on whether a switch condition is satisfied from a plurality of switch conditions comprising:

a user mode-manager mode switch condition, a user mode-error mode switch condition, a manager mode-user mode switch condition, a manager mode-error mode switch condition, and an error mode-user mode switch condition, wherein the security state machine is further configured to switch from the user mode to the error mode when the user mode-error mode switch condition is satisfied, wherein the user mode-error mode switch condition is satisfied when a first input for switching to the manager mode is received via the HMI unit and the door is opened while in a locked state, wherein the manager mode-error mode switch condition corresponds to attempting to return to the user mode via the HMI unit while in an unlocked state or door open state, and the security state machine is further configured to switch from the manager mode to the error mode when the manager mode-error mode switch condition is satisfied, wherein the error mode-user mode switch condition corresponds to the door being closed, the door handle being locked after the door is closed, and receiving a second input via the HMI unit to switch to the user mode after the door handle is locked, and the security state machine is further configured to switch from the error mode to the user mode when the error mode-user mode switch condition is satisfied.

* * * * *